US006874963B2

(12) United States Patent
Yang et al.

(10) Patent No.: US 6,874,963 B2
(45) Date of Patent: Apr. 5, 2005

(54) DRIVING APPARATUS HAVING A FEEDING PART POWER-ENGAGING REMOVAL DEVICE IN IMAGE FORMING APPARATUS

(75) Inventors: Myung-woo Yang, Suwon (KR); Won-taek Kim, Suwon (KR)

(73) Assignee: Samsung Electronics Co., LTD, Suwon-Si (KR)

( * ) Notice: Subject to any disclaimer, the term of this patent is extended or adjusted under 35 U.S.C. 154(b) by 0 days.

(21) Appl. No.: 10/460,477

(22) Filed: Jun. 13, 2003

(65) Prior Publication Data

US 2004/0046851 A1 Mar. 11, 2004

(30) Foreign Application Priority Data

Sep. 7, 2002 (KR) ..... 10-2002-54005

(51) Int. Cl.[7] ..... B41J 11/24

(52) U.S. Cl. ..... 400/641; 400/187; 400/625; 271/256

(58) Field of Search ..... 400/185, 187, 400/625, 636, 637.1, 641; 271/256, 258.01, 272, 314

(56) References Cited

U.S. PATENT DOCUMENTS 3,519,117 A * 7/1970 Smith ..... 400/641
6,390,467 B1 * 5/2002 Fukube ..... 271/256
2001/0043831 A1 * 11/2001 Sugimoto et al. ..... 400/624
2003/0184000 A1 * 10/2003 Kim ..... 271/10.11

* cited by examiner

*Primary Examiner*—Stephen R. Funk
(74) *Attorney, Agent, or Firm*—Staas & Halsey LLP

(57) ABSTRACT

An image forming machine driving apparatus includes a first one direction power transfer part transferring or cutting off a dynamic power of a driving motor to or from a feeding part according to rotation directions of the driving motor, and a feeding part power-engaging removal device cutting off a jammed paper-removing force not to be transferred to the driving motor when the jammed paper-removing force is applied to the feeding part in a power transfer direction of the first one direction power transfer part, thereby preventing the jammed paper from being torn off or damaged when the paper jammed in the feeding part is removed during supplying or feeding the paper. The image forming machine driving apparatus cuts off the transfer of the jammed paper-removing force not to be transferred to the driving motor by the first one direction power transfer part and the feeding part power-engaging removal device regardless of paper-removing directions when a user removes the jammed paper occurring in the feeding part during supplying and feeding the paper, thereby preventing the jammed sheet of paper from being torn off or damaged.

20 Claims, 4 Drawing Sheets

DRIVING APPARATUS HAVING A FEEDING PART POWER-ENGAGING REMOVAL DEVICE IN IMAGE FORMING APPARATUS

CROSS-REFERENCE TO RELATED APPLICATIONS

This application claims the benefit of Korean Application No. 2002-54005, filed Sep. 7, 2002, in the Korean Intellectual Property Office, the disclosure of which is incorporated herein by reference.

BACKGROUND OF THE INVENTION

1. Field of the Invention

The present invention relates to a driving apparatus for an image forming apparatus, such as an office machine including a multi-function device, a laser printer, an inkjet printer, and so on, and more particularly, to an image forming machine driving apparatus having a feeding part power-engaging removal device cutting off a force exerted on a driving gear driving a feeding part when a sheet of paper jammed in the feeding part, such as a pickup roller, a feeding roller, a paper discharge roller, and so on, is removed from the feeding part, while the force is not transferred from the paper to the driving gear, thereby preventing the jammed paper from being ripped off or damaged.

2. Description of the Related Art

In general, an image forming apparatus, such as an office machine including an inkjet printer 10 as shown in FIG. 1, includes a paper supply tray or cassette 1 in which a plurality of sheets of paper P are loaded, a pickup roller 2 supplying the paper P loaded in the paper supply cassette 1, a feeding roller 3 feeding the paper P supplied by the pickup roller 2, a printer head 4 mounted on a carrier 14 to form images on the paper P fed by the feeding roller 3, and a paper discharge roller 5 discharging the image-formed paper P outside the inkjet printer 10.

The pickup roller 2 is coupled with a driving gear 6 of a driving motor (not shown) through a plurality of pickup idle gears 20, 21, and 22 and a pickup roller gear 23, and the feeding roller 3 is coupled with the driving gear 6 through a feeding idle gear 11 and a feeding roller gear 16.

As shown in FIGS. 2A and 2B, on one end 17*a* of a shaft 17 of the feeding roller 3 is installed a one-direction gear part or a spring clutch part 19 which rotates the feeding roller gear 16 without an additional load by not transferring a rotation force of the driving gear 6 to the feeding roller 3 when the driving gear 6 rotates in one direction, for example, in a counterclockwise direction, by the driving motor so that the paper P is picked up by the pickup roller 2, and by transferring the rotation force of the driving gear 6 to the feeding roller 3 when the driving gear 6 rotates in an opposite direction to the one direction, that is, in a clockwise direction, after the paper P reaches the feeding roller 3.

The spring clutch part 19 is provided with a first hub 18*a* of a bushing 18 fixed to the one end 17*a* of the shaft 17 of the feeding roller 3, a second hub 16*a* of the feeding roller gear 16 rotatably installed to the one end 17*a* of the shaft 17 of the feeding roller 3, and a clutch spring 19*a* winding around the first and second hubs 18*a*, 16*a* to generate a sliding friction force on outer circumferences of the first hub 18*a* of the bushing 18 and the second hub 16*a* of the feeding roller gear 16.

As the second hub 16*a* of the feeding roller gear 16 rotates in a winding direction of the clutch spring 19*a*, for example, in the clockwise direction by the feeding idle gear 11 subjected to the rotation force of the driving gear 6 (refer to FIG. 2A), the spring clutch part 19 transfers a dynamic power of the second hub 16*a* of the feeding roller gear 16 to the first hub 18*a* of the bushing 18 disposed nearby the first hub 16*a* since the clutch spring 19*a* comes in tight contact with the outer circumferences of the first and second hubs 18*a* and 16*a* while an inner diameter of the clutch spring 19*a* becomes smaller by the sliding friction force with the first and second hubs 18*a* and 16*a*. Consequently, the dynamic power of the driving gear 6 is transferred to the feeding roller 3 through the feeding idle roller 11 and the feeding roller gear 16 to rotate the feeding roller 3, and thus the paper P is conveyed to the printer head 4.

Further, as the second hub 16*a* of the feeding roller gear 16 rotates in a direction opposite to the winding direction of the clutch spring 19*a*, that is, in the counterclockwise direction, the spring clutch part 19 rotates the feeding roller gear 16 without the additional load since the clutch spring 19*a* becomes spaced-apart from the outer circumferences of the first and second hubs 18*a* and 16*a* while the inner diameter of the clutch spring 19*a* becomes larger by the sliding friction force with the first and second hubs 18*a* and 16*a*. Accordingly, the dynamic power of the driving gear 6 is cut off between the feeding roller gear 16 and the feeding roller 3 so as not to be transferred to the feeding roller 3.

Even though not shown, on the pickup roller gear 23 formed on the shaft of the pickup roller 2 or one of the pickup idle gears 20, 21, and 22 is mounted another one-direction gear part or another spring clutch (not shown) which transfers the rotation force of the driving gear 6 to the pickup roller 2 as the driving gear 6 rotates in another one direction, for example, in the counterclockwise direction, by the driving motor so that the paper P is picked up by the pickup roller 2, and rotates the pickup roller gear 23 or the pickup idle gears 20, 21, and 22 without the additional load by not transferring the rotation force of the driving gear 6 to the pickup roller 2 as the driving gear 6 rotates in the opposite direction, that is, in the clockwise direction, after the paper P reaches the feeding roller 3.

In operations of the inkjet printer 10 having the above structure, when the inkjet printer 10 starts its operation, electric power is applied to the driving motor, by which the driving gear 6 rotates in the one direction, for example, in the counterclockwise direction, to rotate the pickup roller 2, the feeding roller 3, and the paper discharge roller 5.

At this time, the pickup roller 2 rotates in a direction picking up the paper P, that is, in the counterclockwise direction, by the one direction gear part or the spring clutch part 19.

However, the feeding roller 3 remains in a stationary state since it does not receive the dynamic power of the driving gear 6 by the spring clutch part 19.

That is, when the feeding idle gear 11 receiving the rotation force in the counterclockwise direction of the driving gear 6 rotates in the clockwise direction, the feeding roller gear 16 meshed with the feeding idle gear 11 rotates in the counterclockwise direction. Accordingly, the clutch spring 19*a* becomes spaced-apart from the outer circumferences of the first and second hubs 18*a* and 16*a* while the inner diameter of the clutch spring 19*a* becomes larger by the sliding friction force with the first and second hubs 18*a* and 16*a*, so that the feeding roller gear 16 is rotated in the direction opposite to the winding direction without the additional load. Consequently, the dynamic power of the driving gear 6 is cut off between the feeding roller gear 16 and the feeding roller 3 so as not to be transferred to the feeding roller 3.

Further, the paper discharge roller 5 rotates in a direction opposite to a paper convey direction A through the driving gear 6 and a power transfer gear train not shown.

As described above, as the pickup roller 2 rotates in the counterclockwise direction, the paper P loaded in the paper supply cassette 1 is picked by a friction buckler (not shown) and conveyed to the feeding roller 3.

Thereafter, when an upper end, that is, a leading end, of the paper P pushes a sensor actuator 9 of a paper sensor 7, an optical sensor 8 generates an 'on' signal. Accordingly, a controller (not shown) drives the driving motor to rotate the driving gear 6 in the opposite direction, that is, in the clockwise direction.

As the driving gear 6 rotates in the clockwise direction, the transfer of the dynamic power of the driving gear 6 to the pickup roller 2 is cut off by the one direction gear part or the another spring clutch to stop operations of the pickup roller 2. At this time, the dynamic power of the driving gear 6 is transferred to the feeding roller 3 by the spring clutch part 19 to rotate the feeding roller 3 in the paper convey direction A, that is, in the clockwise direction. As a result, the paper P moves to the paper convey direction A and enters between a base frame 12 and the print head 4.

At this time, the paper discharge roller 5 rotates in the paper convey direction, that is, in the clockwise direction through the power transfer gear train.

Thereafter, the controller counts a time period after the optical sensor 8 generates the 'on' signal, and generates a print command to eject ink through ink jet nozzles 4*a* of the printer head 4 if the time period exceeds a predetermined time, that is, if a front end of the paper P passes under ink jet positions of the ink jet nozzles 4*a* and enters up to a predetermined printing location.

Accordingly, the printer head 4 forms an image by ejecting ink on the paper P, sliding in left and right directions with respect to the paper convey direction the carrier 14 supported by a carrier shaft 15.

As described above, the image-printed paper P is externally discharged by the paper discharge roller 5 and a star wheel 5*a*.

However, the conventional inkjet printer 10 has a power transfer/cutoff device, such as the one direction gear part or the spring clutch part 19, mounted to each of the pickup roller 2 and the feeding roller 3, respectively, to transfer or cut off the rotation force of the driving gear 6 to/from the pickup roller 2 and the feeding roller 3 according to the rotation direction of the driving gear 6. Therefore, when the paper P jammed between the pickup roller 2 and the paper supply tray 1 or between the feeding roller 3 and a backup roller 3*a* due to a skewed supply of the paper P is removed, the pickup roller 2 or the feeding roller 3 rotates in a paper removal direction. The paper removal direction may be not the same as the power transfer direction of the one direction gear part or the spring clutch part 19 mounted to the pickup roller 2 of the feeding roller 3. Accordingly, the jammed paper P is easily removed since the pickup roller 2 or the feeding roller 3 rotates without the additional load by a paper removal force. But, the jammed paper P is not easily removed in the same direction since the paper removal force is reversely transferred to the gear train, such as the feeding idle gear 11, the pickup idle gears 20, 21, and 22, the driving gear 6, or the like.

In more detail, in a case that the paper P is jammed in a state that it nearly moves out between the feeding roller 3 and the backup roller 3*a*, a user needs to pull out an externally discharged leading end of the paper P in the paper convey direction A in order to remove the jammed paper P from the inkjet printer 10. At this time, the feeding roller 3 rotates in the clockwise direction by the paper P, so the first hub 18*a* of the bushing 18 of the spring clutch part 19 rotates in the direction opposite to the winding direction of the clutch spring 19*a*. Consequently, the inner diameter of the clutch spring 19*a* becomes larger by the sliding friction force with the first and second hubs 18*a* and 16*a*, and the clutch spring 19*a* is spaced-apart from the outer circumferences of the first and second hubs 18*a* and 16*a*, so that the feeding roller 6 rotates without the additional load. Accordingly, the user can easily remove the jammed paper P between the feeding roller 3 and the backup roller 3*a*.

However, in a case that the paper P is jammed just after the paper P enters between the feeding roller 3 and the backup roller 3*a*, the user needs to pull out a rear end of the paper P located on a side of the paper supply cassette 1 to remove the jammed paper P. At this time, the feeding roller 3 rotates in the counterclockwise direction by the paper P, so that the first hub 18*a* of the bushing 18 of the spring clutch part 19 rotates in the winding direction of the clutch spring 19*a*. As a result, the inner diameter of the clutch spring 19*a* becomes smaller by the sliding friction force with the first and second hubs 18*a* and 16*a* to be in tight contact with the outer circumferences of the first and second hubs 18*a* and 16*a*, so that a rotation force of the first hub 18*a* of the bushing 18 is transferred to the first hub 18*a* of the adjacent feeding roller gear 16. Accordingly, the rotation force of the feeding roller 3 is transferred to the driving gear 6 through the feeding roller gear 16 and the feeding idle roller 11.

In the above case, the rotation force rotating the driving gear 6 is much stronger than a contact pressure between the feeding roller 3 and the backup roller 3*a* having the jammed paper P therebetween, so that the jammed paper P slips between and removed from the feeding roller 3 and the backup roller 3*a* when being pulled out with the rotation force stronger than the contact pressure.

However, at this time, it causes difficulties and inconvenience to remove the jammed paper P since the user must strongly pull out the paper P in order for the jammed paper P to slip between the feeding roller 3 and the backup roller 3*a*.

Further, in a case that the jammed paper P is not so strong enough to sustain an exerted force occurring when the user pulls out the paper P for removal, it becomes more difficult to remove the jammed paper P since the paper P is torn off or damaged, thereby causing a problem that a subsequent paper jam occurs.

SUMMARY OF THE INVENTION

In order to solve the above and/or other problems, it is an object of the present invention to provide a driving apparatus of an image forming machine having a feeding part power-engaging removal device cutting off a transfer of a force to a driving motor to remove a jammed sheet of paper so that the jammed paper is prevented from being torn off or damaged when the paper jammed in a feeding part supplying or feeding the paper is removed.

Additional aspects and advantages of the invention will be set forth in part in the description which follows and, in part, will be obvious from the description, or may be learned by practice of the invention.

In order to achieve the above and/or other aspects of the present invention, an image forming machine driving apparatus includes a driving source driving a feeding part provided with at least one or more rollers feeding a sheet of paper, a first one direction power transfer part transferring or cutting off a dynamic power of the driving source to/from the feeding part according to rotation directions of the driving source, and a feeding part power-engaging removal device cutting off a jammed paper-removing force not to be transferred from the feeding part to the driving source when the jammed paper-removing force is applied in a power transfer direction of the first one direction power transfer part, thereby preventing the jammed paper from being torn off or damaged when the paper jammed in the feeding part during supplying or feeding the paper is moved.

According to another aspect of the present invention, the feeding part power-engaging removal device includes a second one direction power transfer part disposed between a feeding part gear formed on one end of a shaft of the feeding part and a driving gear coaxially formed on the driving source.

The second one direction power transfer part includes a fixed gear rotatably disposed on a fixed shaft to be engaged with the driving gear, and a swing gear installed in association with the fixed gear to be engaged with or released from the feeding part gear according to a rotation direction of the driving gear. At this time, the second one direction power transfer part further includes at least one or more idle gears disposed between the fixed gear and the swing gear to adjust rotation directions of the driving gear.

The first one direction power transfer part includes a spring clutch part having a first hub of a bushing fixed on one end of the shaft of the feeding part, a second hub of the feeding part gear rotatably mounted to one end of the shaft of the feeding part, and a clutch spring winding around the first and second hubs to generate a sliding friction force on outer circumferences of first hub of the bushing and the second hub of the feeding part gear. Alternatively, the first one direction power transfer part can include a feeding part gear formed on one end of the shaft of the feeding part to have a one-way clutch.

The feeding part includes at least one of a pickup roller picking up the paper, a feeding roller feeding the paper, and a paper discharge roller discharging the paper. At this time, the second one direction power transfer part is disposed between the driving gear and a gear formed on one end of a shaft of one of the pickup roller, the feeding roller, and the paper discharge roller.

Alternatively, the feeding part may include the pickup roller picking up the paper, the feeding roller feeding the paper, and the paper discharge roller discharging the paper. At this time, the second one direction power transfer parts are disposed between the driving gear and corresponding ones of pickup, feeding, and paper discharge roller gears respectively formed on ends of shafts of the pickup roller, the feeding roller, and the paper discharge roller.

According to an aspect to the present invention, an image forming machine driving apparatus includes a feeding part having a feeding roller, a driving source driving the feeding roller of the feeding part to feed a sheet of paper in a paper convey direction, a one direction power transfer part disposed between the feeding roller and the driving source to transfer a rotation force of the driving source to the feeding roller to feed the paper in the paper convey direction, and not to transfer the rotation force of the driving source to the feeding roller to prevent the paper from being fed in a direction opposite to the paper convey direction, and a feeding part power-engaging removal unit disposed between the feeding roller of the transfer part and the driving source to control a jammed paper-removing force generated when the paper jammed in the feeding part is removed from the feeding roller of the feeding part in the direction opposite to the paper convey direction, not to be transferred from the feeding roller to the driving source according to a rotation direction of the feeding roller.

According to an aspect to the present invention, an image forming machine driving apparatus printing an image on a sheet of paper fed in a paper convey direction includes a feeding part having a feeding roller and a feeding roller gear rotating the feeding roller to feed the paper in the paper convey direction, a driving source having a driving gear to drive the feeding roller gear to rotate the feeding roller, and a feeding part power-engaging removal unit disposed between the feeding roller gear and the driving gear to transfer a first rotation force from the driving gear to the feeding roller gear and prevent a second rotation force generated by the feeding roller from being transferred form the feeding roller gear to the driving gear.

According to an aspect to the present invention, a method in image forming machine driving apparatus includes rotating a feeding roller of a feeding part ding roller to feed a sheet of paper in a paper convey direction using a driving source driving the feeding roller of the feeding part to feed a sheet of paper in a paper convey direction, causing a one direction power transfer part to be disposed between a feeding roller and a driving source to transfer a rotation force of the driving source to the feeding roller to feed a sheet of paper in a paper convey direction, and not to transfer the rotation force of the driving source to the feeding roller to prevent the paper from being fed in a direction opposite to the paper convey direction, causing a feeding part power-engaging removal unit to be disposed between the feeding roller of the transfer part and the driving source, and controlling a jammed paper-removing force generated when the paper jammed in the feeding part is removed from the feeding roller of the feeding part in the direction opposite to the paper convey direction, not to be transferred from the feeding roller to the driving source according to a rotation direction of the feeding roller.

According to an aspect to the present invention, a method in an image forming machine driving apparatus printing an image on a sheet of paper fed in a paper convey direction includes rotating a feeding roller to feed the paper in the paper convey direction using a driving source having a driving gear, causing a feeding part power-engaging removal unit to be disposed between the feeding roller gear and the driving gear, transferring a first rotation force from the driving gear to the feeding roller gear, and preventing a second rotation force generated by the feeding roller from being transferred form the feeding roller gear to the driving gear.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
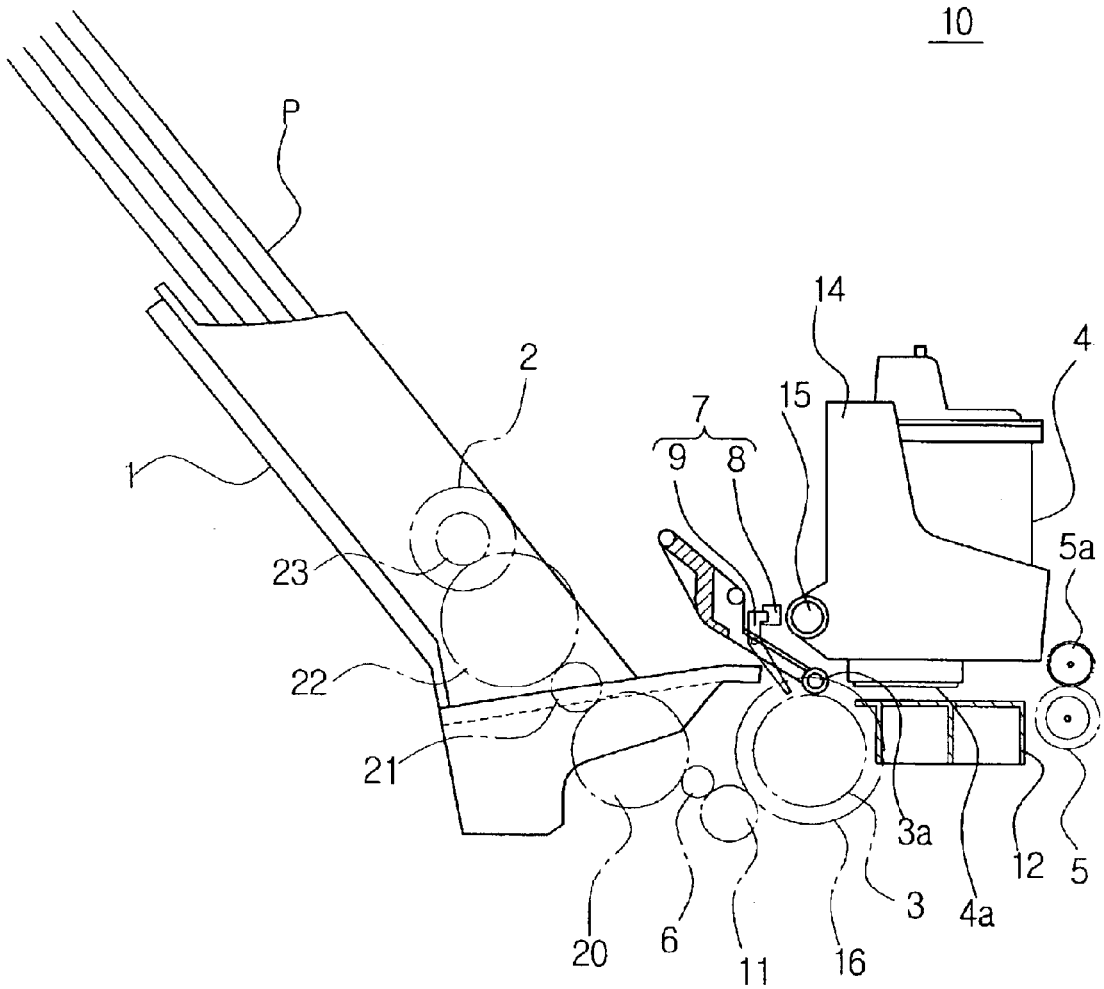
FIG. 1 (PRIOR ART)
FIG. 1 is a side view partially showing a conventional inkjet printer.
Figure 2A:
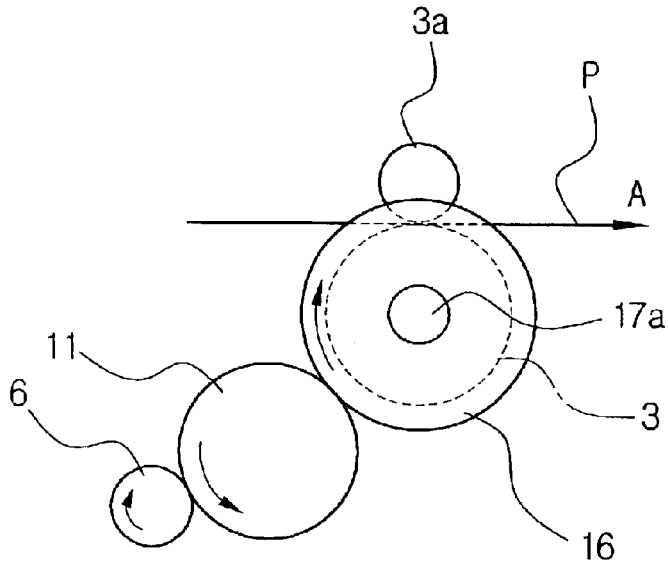
FIG.2A (PRIOR ART)
FIGS. 2A and 2B are side and plan views schematically showing a feeding roller driving part of a driving device of the inkjet printer shown in FIG. 1.
Figure 2B:
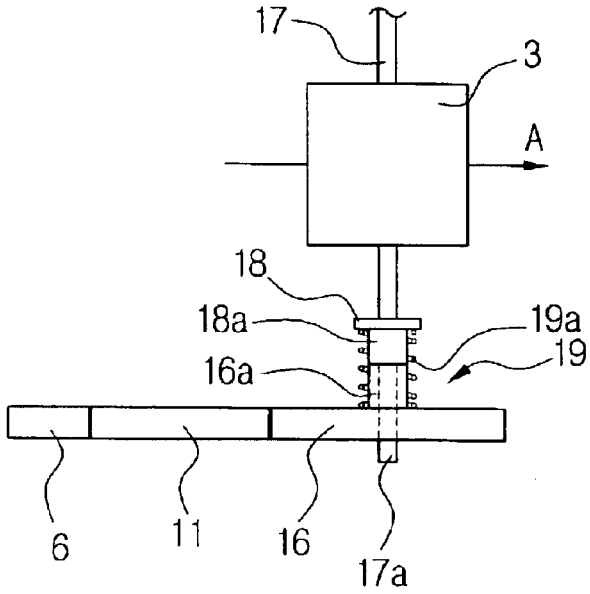
FIG.2B (PRIOR ART)

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Hereinafter, a detailed description is made on an office machine driving apparatus having a feeding part power-engaging removal device according to a preferred embodiment of the present invention with reference to the accompanying drawings.

An image forming machine driving apparatus having a feeding part power-engaging removal device according to an embodiment of the present invention is applied to an image forming apparatus, such as an office machine, including an inkjet printer 10 shown in FIG. 1, and includes a paper supply cassette (not shown) in which a plurality of sheets of paper P are loaded, a feeding part provided with a pickup roller (not shown) picking up and supplying the paper P loaded in the paper supply cassette, a feeding roller 103 feeding the paper picked up by the pickup roller, and a paper discharge roller (not shown) externally discharging the paper P, a printing part (not shown) provided with a printer head forming images on the paper P fed by the feeding roller 103, and a driving apparatus 100 driving the pickup roller, the feeding roller 103, and the paper discharge roller.

The driving apparatus includes a driving motor (not shown), a driving gear 106 coaxially formed on a shaft of the driving motor, a pickup roller driving part (not shown) driving the pickup roller, a feeding roller driving part 104 driving the feeding roller 103, and a paper discharge driving part (not shown) driving the paper discharge roller.

The pickup roller driving part includes a pickup gear train having a pickup roller gear (not shown) formed on a shaft of the pickup roller, and a plurality of pickup idle gears (not shown) disposed between the pickup roller gear and the driving gear 106 to rotate the pickup roller gear in a paper feeding direction A when the driving gear 106 rotates in a counterclockwise direction as in the inkjet printer 10 shown in FIG. 1.

Figure 3A:
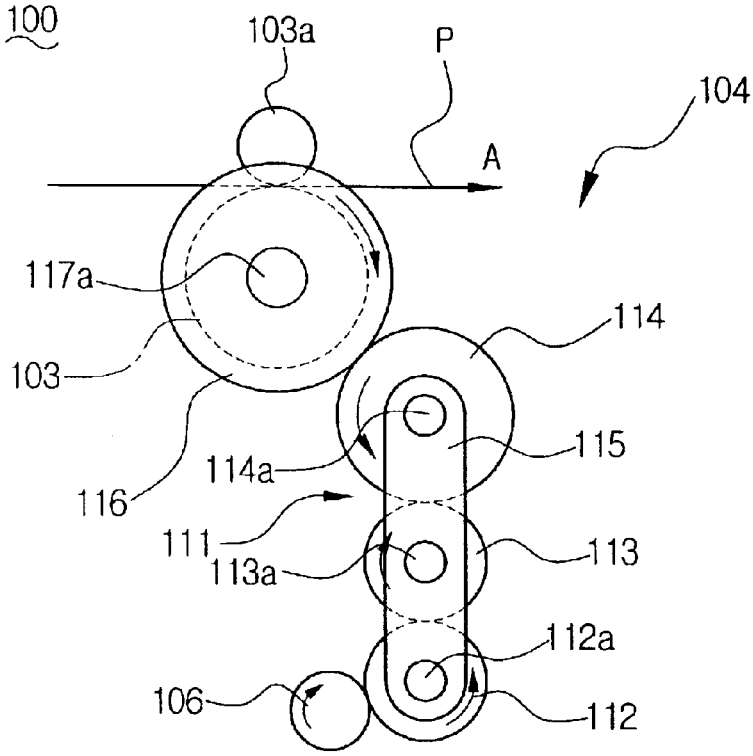
FIGS. 3A and 3B are side and plan views schematically showing a feeding roller driving part of an image forming machine driving apparatus having a feeding part power-engaging removal device according to an embodiment of the present invention.
Figure 3B:
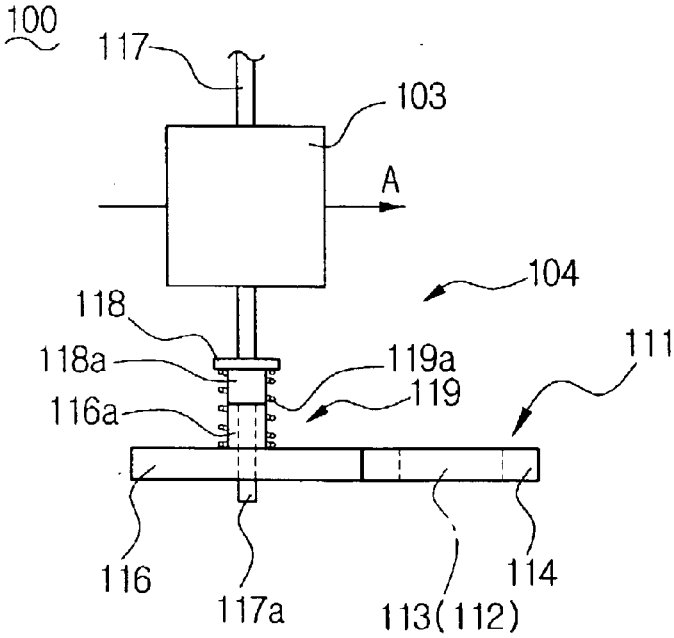

As shown in FIGS. 3A and 3B, the feeding roller driving part 104 is provided with a feeding roller gear 116 formed on one end 117*a* of a shaft 117 of the feeding roller 103 and a feeding roller power-engaging removal device 111 disposed between the driving gear 106 and the feeding roller gear 116. On the one end 117*a* of the shaft 117 of the feeding roller 103 is installed a spring clutch part 119 as a first one direction power transfer part.

The spring clutch part 119, as in the spring clutch part 19 of the inkjet printer 10 shown in FIG. 1, has a first hub 118*a* of a bushing 118 fixed to the one end 117*a* of the shaft 117 of the feeding roller 103, a second hub 116*a* of the feeding roller gear 116 rotatably mounted to the one end 117*a* of the shaft 117 of the feeding roller 103, and a clutch spring 119*a* winding around the first and second hubs 118*a*, 116*a* to generate a sliding friction force on outer circumferences of the first hub 118*a* of the bushing 118 and the second hub 116*a* of the feeding roller gear 116.

When the feeding roller gear 116 rotates in one direction, that is, in the counterclockwise direction, the spring clutch part 119 rotates the feeding roller gear 116 without an additional load by not transferring a rotation force of the feeding roller gear 116 to the feeding roller 103 since the clutch spring 119*a* becomes unwound in a direction opposite to a winding direction, that is, the clutch spring 119*a* becomes spaced-apart (released) from the first and second hubs 118*a*, 116*a*. When the feeding roller gear 116 rotates in the other direction, for example, in the clockwise direction (refer to FIG. 3A), the spring clutch part 119 transfers the rotation force of the feeding roller gear 116 to the feeding roller 103 since the clutch spring 119*a* becomes wound in the winding direction, that is, the clutch spring 119*a* comes in contact with the first and second hubs 118*a*, 116*a*.

Further, when the feeding roller 103 rotates in the clockwise direction by pulling out a jammed paper P in the paper feeding direction A to remove the jammed paper P between the feeding roller 103 and a backup roller 103*a* (refer to FIG. 4A), the spring clutch part 119 rotates the feeding roller 103 not to transfer the rotation force of the feeding roller 103 to the feeding roller gear 116 since the clutch spring 119*a* becomes unwound in the opposite direction to the winding direction. When the feeding roller 103 rotates in the counterclockwise direction to remove the jammed paper P in an opposite paper feeding direction B (refer to FIG. 4B), the spring clutch part 119 transfers the rotation force of the feeding roller 103 to the feeding roller gear 116 since the clutch spring 119*a* becomes wound in the winding direction.

Alternatively, in the spring clutch part 119 used as the first one direction power transfer part, the feeding roller gear 116 formed on the one end 117*a* of the shaft 117 of the feeding roller 103 can be substituted with a one-way gear (not shown) having a known one-way clutch (not shown) operating in the same principle as the spring clutch part 119.

The one-way clutch is generally provided with teeth formed to have a certain angle in a predetermined direction inside an external gear, for example, the feeding roller gear 116. The one-way clutch is also provided with an internal gear rotatably and coaxially arranged inside the external gear and having a plurality of hooks or latches engaged with the teeth inside the external gear when rotating in the predetermined direction, and released when rotating in a direction opposite to the predetermined direction.

The feeding roller power-engaging removal device 111 disposed between the driving gear 106 and the feeding roller gear 116 includes a fixed gear 112 rotatably arranged on the fixed shaft 112*a* to be engaged with the driving gear 106, an idle gear 113 rotatably mounted to a first idle shaft 113*a* to be coupled with the fixed gear 112 so as to change rotation directions transmitted from the driving gear 106, and a swing gear 114 rotatably mounted to a second idle shaft 114*a* to be engaged with the idle gear 113 so as to be engaged with or released from the feeding roller gear 116 according to the rotation directions of the driving gear 106 and the feeding roller gear 116.

The first idle shaft 113*a* of the idle gear 113 and the second idle shaft 114*a* of the swing gear 114 are coupled with the fixed shaft 112*a* of the fixed gear 112 by a connection link 115 so that the swing gear 114 and the idle gear 113 can rotate about the fixed shaft 112*a* of the fixed gear 112 according to the rotation direction of the driving gear 106 and the feeding roller gear 116.

The feeding roller power-engaging removal device 111 has a function of a second one direction power transfer part cutting off the rotation force of the feeding roller 103 so as not to be transferred to the driving gear 106 when a force for removing the jammed paper P is applied to the feeding roller 103 in a power transfer direction of the spring clutch part 119 constituting the first one direction power transfer part, that is, when the feeding roller 103 rotates in the counterclockwise direction to wind the clutch spring 119*a* in the winding direction. Therefore, the rotation force of the feeding roller 103 is transferred to the feeding roller gear 116 (refer to FIG. 4B) when the jammed paper P is removed from a nip between the feeding roller 103 and the backup roller 103*a* during supplying or feeding the paper P.

Figure 4A:
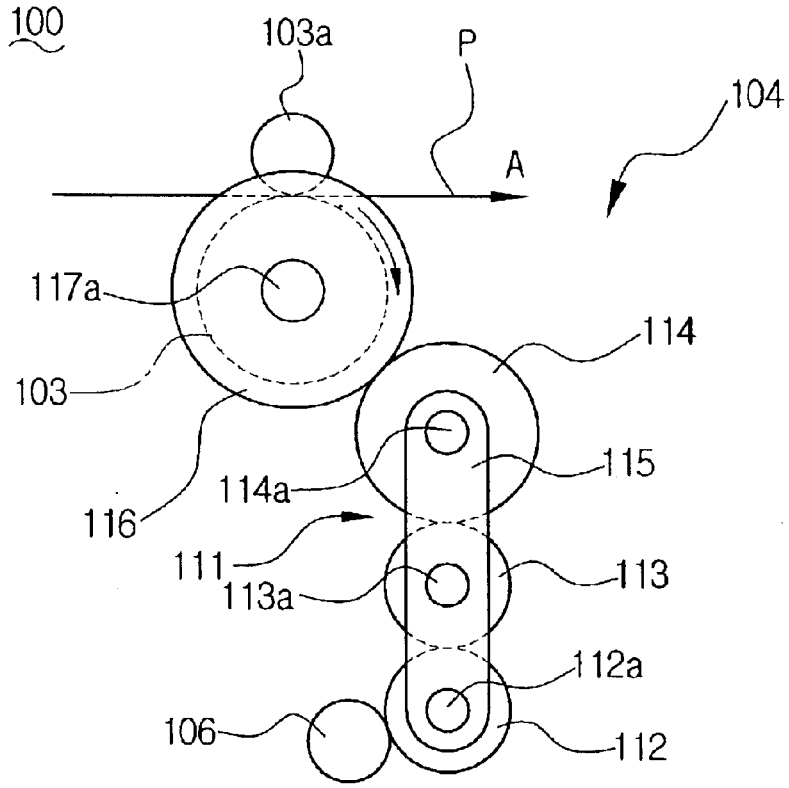
FIGS. 4A and 4B are schematic side views illustrating operation states of the feeding roller driving part shown in FIG. 3A when a jammed sheet of paper is removed.
Figure 4B:
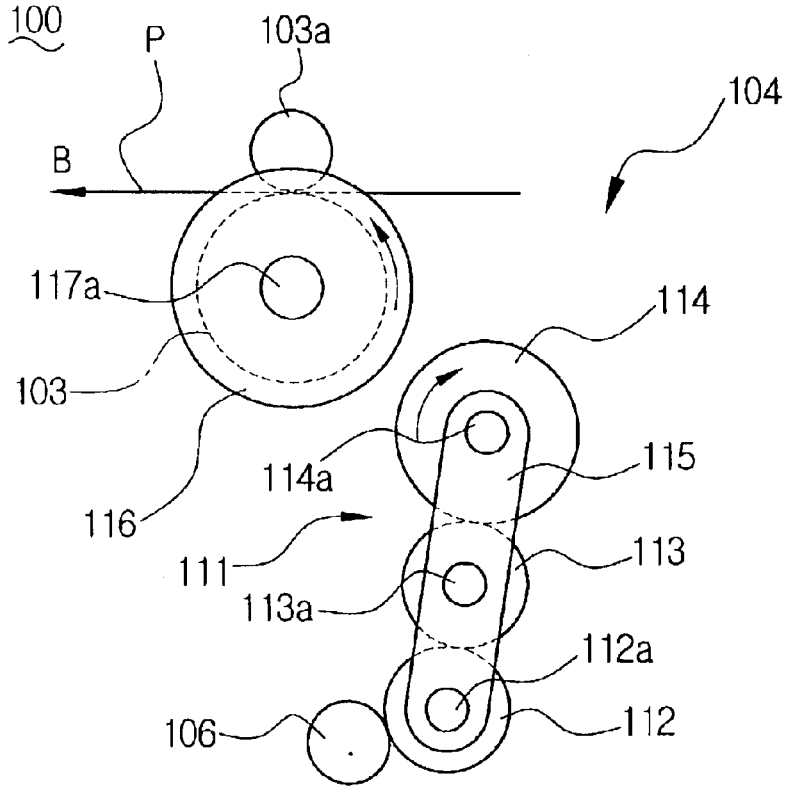

In more detail, as shown in FIG. 4B, in a case that the paper P is jammed just after it moves into the nip between the feeding roller 103 and the backup roller 103*a*, a user pulls out a rear end of the paper P located on a side of the paper supply cassette toward the opposite paper feeding direction B opposite to the paper feeding direction A in order to remove the jammed paper P. At this time, the feeding roller 103 rotates in the counterclockwise direction by the paper P, so that the spring clutch part 119 transfers the rotation force of the first hub 118*a* of the bushing 118 to the second hub 116*a* of the adjacent feeding roller gear 116 while the clutch spring 119*a* becomes wound in the winding direction.

Consequently, the rotation force of the feeding roller 103 is transferred to the feeding roller gear 116, and the feeding roller gear 116 rotates in the counterclockwise direction. Therefore, the swing gear 114 coupled with the fixed gear 112 and the idle gear 113 by the connection link 115 rotates in the clockwise direction about the fixed shaft 112*a* of the fixed gear 112 to be spaced-apart from the feeding roller gear 116, so that the rotation force of the feeding roller gear 116 is not transferred to the driving gear 106.

Accordingly, the user can easily remove the jammed paper P between the feeding roller 103 and the backup roller 103*a* without causing damage to the paper P by rotating only the feeding roller gear 116.

However, as shown in FIG. 4A, in a case that the paper jam occurs in a state that the paper P nearly moves out from the nip between the feeding roller 103 and the backup roller 103*a*, the paper P is easily removed by the spring clutch part 119 without using the feeding roller power-engaging removal device 111 like in the conventional printer 10 shown in FIG. 1.

That is, in order to remove the jammed paper P, the user pulls out a leading end of the paper P externally discharged through the paper discharge roller in the paper feeding direction A. At this time, the feeding roller 103 rotates in the clockwise direction by the paper P, and, accordingly, the spring clutch part 119 does not transfer the rotation force of the first hub 118*a* of the bushing 118 to the second hub 116*a* of the feeding roller gear 116 since the clutch spring 119*a* becomes unwound in the direction opposite to the winding direction. Therefore, the feeding roller 103 rotates without the additional load, so that the paper P is easily removed from the nip between the feeding roller 103 and the backup roller 103*a*.

Further, the feeding roller power-engaging removal device 111 of the feeding roller driving part 104 cuts off the rotation force of the driving gear 106 so as not to be transferred to the feeding roller gear 116 as the driving gear 106 rotates in the counterclockwise direction to drive the pickup roller, and transfers the rotation force of the driving gear 106 to the feeding roller gear 116 as the driving gear 106 rotates in the clockwise direction (refer to FIG. 3A) to drive the feeding roller 103.

In more detail, as the driving gear 106 rotates in the counterclockwise direction to drive the pickup roller, the fixed gear 112 rotates in the clockwise direction about the fixed shaft 112*a* by the rotation force of the driving gear 106 in the counterclockwise direction, the swing gear 114 rotates in the clockwise direction about the fixed shaft 112*a* so that it becomes spaced-apart from the feeding roller gear 116. Accordingly, the rotation force of the driving gear 106 is cut off so as not to be transferred to the feeding roller gear 116.

As shown in FIG. 3A, when the driving gear 106 rotates in the clockwise direction to drive the feeding roller 103, the fixed gear 112 rotates in the counterclockwise direction about the fixed shaft 112*a* of the fixed gear 112 by the rotation force of the driving gear 106 in the clockwise direction, and the swing gear 114 comes in close contact with the feeding roller gear 116 to rotate in the counterclockwise direction. As the swing gear 114 rotates in the counterclockwise direction, the feeding roller gear 116 rotates in the clockwise direction. Accordingly, the spring clutch part 119 transfers the rotation force of the feeding roller gear 116 to the feeding roller 103 since the clutch spring 119*a* becomes wound in the winding direction, so that the paper P is fed in the paper feeding direction A.

A paper discharge roller driving part of the driving apparatus 100 includes a paper discharge gear train having a paper discharge roller gear (not shown) formed on a shaft of the paper discharge roller, and a plurality of paper discharge idle gears (not shown) disposed between the driving gear 106 and the paper discharge roller gear to rotate the paper discharge roller gear in the paper feeding direction A as the driving gear 106 rotates in the clockwise direction to drive the feeding roller 103.

As described above, descriptions are made on the driving apparatus 100 of the inkjet printer in which only the feeding roller driving part 104 is provided with the spring clutch part 119 and the feeding roller power-engaging removal device 111 as the first and second one direction power transfer parts, but it should be understood that the first and second one direction power transfer parts having the same structure as the feeding roller driving part 104 may be mounted on the pickup roller driving part and the paper discharge roller driving part to cut off and transfer a rotation power of gear trains of the pickup roller driving part and the paper discharge roller driving part and to remove the paper P jammed between the pickup roller and the paper discharge roller without causing a force to be exerted on the driving apparatus 100.

That is, even though not shown, on either the pickup roller gear formed on the shaft of the pickup roller or one of the pickup idle gears is mounted the one direction gear part or the spring clutch part (not shown) 119 as the first one direction power transfer part that transfers the rotation force of the driving gear 106 to the pickup roller, when the driving gear 106 rotates in the one direction, for example, in the counterclockwise direction by the driving motor so that a the paper P is fed by the pickup roller, and the first one directional power transfer part rotates the pickup roller gear or the pickup idle gears without the additional load by not transferring the rotation force of the driving gear 106 to the pickup roller when the driving gear 106 rotates in the other direction, that is, in the clockwise direction after the paper P reaches the feeding roller 103.

Further, a pickup roller power-engaging removal device (not shown) is installed as the second one direction power transfer part at a suitable position between the pickup roller gear or the pickup idle gear provided with the first one direction power transfer part and the driving gear.

Further, on the paper discharge roller gear of the paper discharge roller driving part is mounted the one direction gear part or the spring clutch part 119 as the first one direction power transfer part, and the paper discharge roller power-engaging removal device (not shown) is installed as a second one direction power transfer part at another suitable position between the paper discharge roller gear or the paper discharge idle gear and the driving gear.

Operation of the driving apparatus 100 having the feeding part power-engaging removal device 111 as structured above according to the present invention will be described as follows with reference to FIGS. 3A, 3B, 4A, and 4B.

First, when the image forming apparatus starts its operation, electric power is applied to the driving motor, and, accordingly, the driving gear 106 rotates in the counterclockwise direction to rotate the pickup roller, the feeding roller 103, and the paper discharge roller.

At this time, the pickup roller rotates in a paper pickup direction, that is, in the counterclockwise direction by the one direction gear part (not shown) or the spring clutch part of the pickup gear train.

However, at this time, the feeding roller 103 remains in a stationary state since the feeding roller 103 does not receive the power of the driving gear 106 by the feeding roller blocking removal device 111.

That is, the fixed gear 112 receiving the rotation force of the driving gear 106 in the counterclockwise direction rotates in the clockwise direction about the fixed shaft 112*a*, so that the swing gear 114 rotates in the clockwise direction about the fixed shaft 112*a*. Consequently, the swing gear 114 becomes spaced-apart from the feeding roller gear 116. Therefore, the rotation force of the driving gear 106 is cut off so as not to be transferred to the feeding roller gear 116.

Further, the paper discharge roller also remains in the stationary state by the paper discharge roller power-engaging removal device of the paper discharge gear train.

As above, as the pickup roller rotates in the counterclockwise direction, the paper P loaded in the paper supply cassette are picked up by a friction buckler (not shown) and fed to the feeding roller 103.

Thereafter, when an upper end, that is, a leading end of the paper P operates the paper sensor (not shown), a controller drives the driving motor to rotate the driving gear 106 in the clockwise direction.

As the driving gear 106 rotates in the clockwise direction, the pickup roller stops since the power transfer of the driving gear 106 is cut off from the driving gear 106 by the one direction gear part or the spring clutch part of the pickup gear train, and the feeding roller 103 rotates in the paper feeding direction A, that is, in the clockwise direction since the power of the driving gear 106 is transferred thereto by the feeding roller power-engaging removal device 111 and the spring clutch part 119 as shown in FIG. 3A, so that the paper sheet is fed in the paper feeding direction A.

At this time, the paper discharge roller rotates in the clockwise direction by the paper discharge roller power-engaging removal device and the spring clutch part of the paper discharge gear train.

Thereafter, the controller counts a period of time lapsed after the paper sensor operates, and, when a predetermined period of time lapses, the controller generates a print command to proceed with printing using a printhead.

Accordingly, the printer head jets ink on the paper P to form images on the paper P, and the image-formed paper P is externally discharged out of the image forming apparatus by the paper discharge roller.

However, at this time, when the paper jam occurs by a skewed supply of the paper P or the like in a state that the paper P is just fed into the nip between the feeding roller 103 and the backup roller 103*a*, a rear end of the paper P located on a side of the paper supply cassette is pulled out in the direction B opposite to the paper feeding direction A as shown in FIG. 4B. At this time, the feeding roller 103 rotates in the counterclockwise direction by the paper P, and, accordingly, the spring clutch part 119 transfers the rotation force of the feeding roller 103 to the feeding roller gear 116 since the clutch spring 119*a* becomes wound in the winding direction, but the feeding roller power-engaging removal device 111 becomes spaced-apart from the feeding roller 116 when the swing gear 114 rotates in the clockwise direction about the fixed shaft 112*a* of the fixed gear 112 so that the rotation force of the feeding roller gear 116 is not transferred to the driving gear 106. Further, the spring clutch part of the pickup roller driving part and the pickup roller power-engaging removal device also operates using the same principle so that the rotation force of the pickup roller is not transferred to the driving gear 106. Accordingly, user can easily remove the paper P jammed between the feeding roller 103 and the backup roller 103*a* without damage.

Further, at this time, in a case that the paper jam occurs by the skewed supply of the paper P in a state that the paper P nearly moves out of the nip between the feeding roller 103 and the backup roller 103*a*, the jammed paper P can be easily removed by the spring clutch part 119 of the feeding roller driving part 104 and the paper discharge driving part.

That is, in order to remove the jammed paper P, as shown in FIG. 4A, the user pulls out the jammed paper P in the paper feeding direction A externally discharged through the paper discharge roller. At this time, the feeding roller 103 and the paper discharge roller rotate in the clockwise direction by the paper P, and, accordingly, the spring clutch part 119 of the feeding roller driving part 104 and the paper discharge roller driving part do not transfer the rotation force of the feeding roller 103 and the paper discharge roller to the feeding roller gear 116 and the paper discharge roller gear respectively. Accordingly, the feeding roller 106 and the paper discharge roller rotate without the additional load, and the jammed paper P can be easily removed from the nip between the feeding roller 103 and the backup roller 103*a* and from another nip between the paper discharge roller and a star wheel rotating together with the paper discharge roller.

As described above, the image forming machine driving apparatus having the feeding part power-engaging removal device according to the present invention cuts off the transfer of the jammed paper-removing force to the driving motor by the spring clutch part and the feeding part power-engaging removal device regardless of paper-removing directions when the user removes the paper P jammed in the feeding part, such as the pickup roller, the feeding roller, the paper discharge roller, and the like, during supplying and feeding the paper P, thereby preventing the jammed paper P from being torn off or damaged.

While the invention has been shown and described with reference to a certain preferred embodiment thereof, it will be understood by those skilled in the art that various changes and in form and details may be made therein without departing from the spirit and scope of the invention as defined by the appended claims and their equivalents.

What is claimed is:

1. An image forming machine driving apparatus comprising:

a feeding part provided with one or more rollers feeding a sheet of paper;

a driving source driving the feeding part;

a first one direction power transfer part transferring or cutting off a dynamic power of the driving source to or from the feeding part according to rotation directions of the driving source;

a feeding part power-engaging removal unit cutting off a jammed paper-removing force by releasing the feeding part from the driving source, so as to prevent the jammed paper-removing force from being transferred to the driving source when the jammed paper-removing force is applied to the feeding part in a power transfer direction of the first one direction power transfer part, so that the jammed paper is prevented from being torn off or damaged when the paper jammed in the feeding part is removed during supplying or feeding the paper.

2. The image forming machine driving apparatus as claimed in claim 1, wherein:

the driving source comprises, a driving gear coaxially formed on the driving source;

the feeding part comprises, a shaft; and the feeding part power-engaging removal unit comprises, a feeding part gear formed on one end of the shaft of the feeding part, and a second one direction power transfer part disposed between a pickup roller gear or pickup idle gear and the driving gear coaxially formed on the driving source.

3. The image forming machine driving apparatus as claimed in claim 2, wherein the second one direction power transfer part comprises:

a fixed gear rotatably disposed on a fixed shaft to be engaged with the driving gear; and a swing gear installed in association with the fixed gear to be engaged with or released from the feeding part gear according to a rotation direction of the driving gear.

4. The image forming machine driving apparatus as claimed in claim 3, wherein the second one direction power transfer part further comprises:

one or more idle gears disposed between the fixed gear and the swing gear to change the rotation directions transmitted from the driving source.

5. The image forming machine driving apparatus as claimed in claim 1, wherein the feeding part comprises:

at least one of a pickup roller picking up the paper, a feeding roller feeding the paper, and a paper discharge roller discharging the sheet of paper.

6. The image forming machine driving apparatus as claimed in claim 5, wherein:

the driving source comprises, a driving gear coaxially formed on the driving source;

the feeding part comprises, a gear formed on one end of a shaft of one of the pickup roller, the feeding roller, and the paper discharge roller; and the feeding part power-engaging removal unit comprises:

a second one direction power transfer part disposed between the driving gear and the gear formed on the one end of the shaft of the paper discharge roller.

7. The image forming machine driving apparatus as claimed in claim 1, wherein the feeding part comprises:

a pickup roller picking up the paper;

a feeding roller feeding the paper; and a paper discharge roller discharging the paper.

8. The image forming machine driving apparatus as claimed in claim 7, wherein:

the driving source comprises, a driving gear coaxially formed on the driving source;

the feeding part comprises, pickup, feeding, and paper discharge roller gears respectively forming ends of shafts of the pickup roller, the feeding roller, and the paper discharge roller; and the feeding part power-engaging removal unit comprises:

a second one direction power transfer part disposed between the driving gear and one of the pickup, feeding, and paper discharge roller gears.

9. An image forming machine driving apparatus comprising:

a feeding part having a feeding roller;

a driving source driving the feeding roller of the feeding part to feed a sheet of paper in a paper convey direction;

a one direction power transfer part disposed between the feeding roller and the driving source to transfer a rotation force of the driving source to the feeding roller to feed the paper in the paper convey direction, and not to transfer the rotation force of the driving source to the feeding roller to prevent the paper from being fed in a direction opposite to the paper convey direction; end a feeding part power-engaging removal unit disposed between the feeding roller of the feeding part and the driving source to control a jammed paper-removing force generated when the paper jammed in the feeding part is removed from the feeding roller of the feeding part in the direction opposite to the paper convey direction by releasing the feeding part from the driving source, so that the jammed paper-removing force is not transferred from the feeding roller to the driving source according to a rotation direction of the feeding roller.

10. The image forming machine driving apparatus as claimed in claim 9, wherein the feeding part comprises a shaft formed on the feeding roller, a first hub coupled to the shaft, a feeding roller gear selectively connected to the feeding part power-engaging removal unit, a second hub coupled to the feeding roller gear, and an elastic member disposed between the first and second hubs to selectively transfer the rotation force of the driving source to the feeding roller through the first and second hubs according to a rotation direction of the first and second hubs.

11. The image forming machine driving apparatus as claimed in claim 10, wherein the elastic member comprises:

a spring winding around the first and second hubs in a winding direction from the second hub to the first hub.

12. The image forming machine driving apparatus as claimed in claim 9, wherein the driving source comprises a driving gear, the feeding part comprises a feeding roller gear, and the feeding part power-engaging removal unit is disposed to transfer the rotation force from the driving gear to the feeding roller gear.

13. An image forming machine driving apparatus comprising:

a feeding part having a feeding roller;

a driving source driving the feeding roller of the feeding part to feed a sheet of paper in a paper convey direction;

a one direction power transfer part disposed between the feeding roller and the driving source to transfer a rotation force of the driving source to the feeding roller to feed the paper in the paper convey direction, and not to transfer the rotation force of the driving source to the feeding roller to prevent the paper from being fed in a direction opposite to the paper convey direction; and a feeding part power-engaging removal unit disposed between the feeding roller of the feeding part and the driving source to control a jammed paper-removing force generated when the paper jammed in the feeding part is removed from the feeding roller of the feeding part in the direction opposite to the paper convey direction so that the jammed paper-removing force is not transferred from the feeding roller to the driving source according to a rotation direction of the feeding roller, wherein the driving source comprises a driving gear, the feeding part comprises a feeding roller gear, and the feeding part power-engaging removal unit is disposed to transfer the rotation force from the driving gear to the feeding roller gear, and the feeding part power-engaging removal unit comprises:

a fixed gear contacting the driving gear;

a swinging gear selectively contacting the feeding roller gear; and an idle gear connected between the fixed gear and the swinging gear.

14. The image forming machine driving apparatus as claimed in claim 13, wherein the feeding part power-engaging removal unit comprises:

a connecting link connecting the fixed gear, the swinging gear, and the idle gear.

15. An image forming machine driving apparatus comprising:

a feeding part having a feeding roller;

a driving source driving the feeding roller of the feeding part to feed a sheet of paper in a paper convey direction; and feeding part power-engaging removal unit disposed between the feeding roller of the feeding part and the driving source to control a jammed paper-removing force generated when the paper jammed in the feeding part is removed from the feeding roller of the feeding part in a direction opposite to the paper convey direction, by releasing the feeding part from the driving source, so that the jammed paper-removing force is not transferred from the feeding roller to the driving source.

16. The image forming machine driving apparatus as claimed in claim 15, wherein the feeding part comprises a feeding roller gear coaxially coupled to the feeding roller, and the feeding part power-engaging removal unit transfers a rotation power from the driving source to the feeding roller through the feeding roller gear to rotate the feeding roller in the paper convey direction.

17. An image forming machine driving apparatus comprising:

a feeding part having a feeding roller, a pickup roller, and a discharge roller;

a driving source driving the feeding roller, the pickup roller, and the discharge roller of the feeding part to feed a sheet of paper in a paper convey direction; and a feeding part power-engaging removal unit disposed between the driving source and one of the feeding roller, the pickup roller, and the discharge roller of the feeding part and the driving source to control a jammed paper-removing force generated when the paper jammed in the feeding part is removed from the one of feeding roller, the pickup roller, and the discharge roller of the feeding part in both the paper convey direction and a direction opposite to the paper convey direction by releasing the feeding part from the driving source, so that the jammed paper-removing force is not transferred from the one of the feeding roller, the pickup roller, and the discharge roller of the feeding part to the driving source.

18. An image forming machine driving apparatus printing an image on a sheet of paper fed in a paper convey direction, comprising:

a driving source having a driving gear to generating a first rotation force; and a feeding part having a feeding roller generating a second rotation force and a feeding roller gear having a common axis with the feeding roller to receive the first rotation force and the second rotation force;

a one direction power transfer part disposed between the feeding roller and the feeding roller gear to transfer the first rotation force from the feeding roller gear to the feeding roller; and a feeding part power-engaging removal unit disposed between the feeding roller gear and the driving gear to transfer the first rotation force of the driving gear to the feeding roller gear and prevent the second rotation force from being transferred from the feeding roller gear to the driving gear by releasing the feeding part from the driving source.

19. A method in an image forming machine driving apparatus, the method comprising:

rotating a feeding roller of a feeding part to feed a sheet of paper in a paper convey direction using a driving source;

causing a one direction power transfer part to be disposed between the feeding roller and a driving source to transfer a rotation force of the driving source to the feeding roller to feed a sheet of paper in a paper convey direction, and not to transfer the rotation force of the driving source to the feeding roller to prevent the paper from being fed in a direction opposite to the paper convey direction;

causing a feeding part power-engaging removal unit to be disposed between the feeding roller of the transfer part and the driving source; and controlling a jammed paper-removing force generated when the paper jammed in the feeding part is removed from the feeding roller of the feeding part in the direction opposite to the paper convey direction by releasing the feeding part from the driving source, so as to prevent the jammed paper-removing force from being transferred from the feeding roller to the driving source according to a rotation direction of the feeding roller.

20. A method in an image forming machine driving apparatus printing an image on a sheet of paper fed in a paper convey direction, comprising:

rotating a feeding roller to feed the paper in the paper convey direction using a driving source having a driving gear;

causing a feeding part power-engaging removal unit to be disposed between a feeding roller gear and the driving gear;

transferring a first rotation force from the driving gear to the feeding roller gear; and preventing a second rotation force generated by the feeding roller from being transferred from the feeding roller gear to the driving gear by releasing the feeding part from the driving source.

* * * * *

UNITED STATES PATENT AND TRADEMARK OFFICE

CERTIFICATE OF CORRECTION

PATENT NO. : 6,874,963 B2
DATED : April 5, 2005
INVENTOR(S) : Myung-woo Yang et al.

It is certified that error appears in the above-identified patent and that said Letters Patent is hereby corrected as shown below:

Column 13,
Line 26, after “or” insert -- a --.

Column 15,
Line 35, before “feeding” insert -- a --.

Signed and Sealed this

Twenty-ninth Day of November, 2005

JON W. DUDAS
*Director of the United States Patent and Trademark Office*